United States Patent [19]

Witt

[11] Patent Number: 4,858,872

[45] Date of Patent: Aug. 22, 1989

[54] COASTERS

[76] Inventor: Russell Witt, P.O. Box 924044, Houston, Tex. 77292

[21] Appl. No.: 265,522

[22] Filed: Nov. 1, 1988

[51] Int. Cl.[4] ..... A47B 91/00

[52] U.S. Cl. ..... 248/346.1; 248/146

[58] Field of Search ..... 248/346.1, 346, 146, 248/311.2; 215/100.5; 220/85 H; D7/45

[56] References Cited

U.S. PATENT DOCUMENTS

| | | | |
|---|---|---|---|
| 482,603 | 9/1892 | Weigel | 248/346.1 |
| 2,118,326 | 5/1938 | Richardson | 248/346.1 |
| 2,496,157 | 1/1950 | Gaudino | 248/346.1 |
| 3,268,198 | 8/1966 | Swett | 248/346.1 |
| 4,040,549 | 8/1977 | Sadler | 220/85 H |
| 4,089,498 | 5/1978 | Woodruff | 248/346 X |
| 4,206,570 | 6/1980 | Cooper | 215/100.5 |
| 4,546,946 | 10/1985 | Jenison | 248/346 |

FOREIGN PATENT DOCUMENTS

| | | | |
|---|---|---|---|
| 400234 | 7/1909 | France | 248/346.1 |
| 58881 | 3/1912 | Switzerland | 248/346.1 |
| 299659 | 11/1928 | United Kingdom | 248/346.1 |

*Primary Examiner*—J. Franklin Foss
*Attorney, Agent, or Firm*—Dowell & Dowell

[57] ABSTRACT

A coaster for supporting glasses and other containers and which includes a tray which is mounted in spaced vertical relationship with respect to a base element in such a manner that an open air space is created therebetween and wherein the tray is provided with a plurality of drain openings which communicate with an absorbent pad or wick material which is mounted beneath or suspended from the tray so as to receive condensation and other moisture passing through the drain openings.

12 Claims, 2 Drawing Sheets

COASTERS

BACKGROUND OF THE INVENTION

1. Field of the Invention

This invention is generally directed to coasters of the type which are used to support glasses and other containers relative to a table top or other furniture surface so that the surface is protected from the condensation and other moisture which may collect along the sides and base of the container or glassware. More particularly, the invention is directed to a type of coaster which includes an absorbent material for collecting condensate and other moisture which develops on the surface of the glass or other container and which is constructed so as to direct the absorbed moisture to an area remote from the container where the moisture is subject to a ventilated air space so that such collected moisture may be evaporated to maintain the coaster in as dry a state as possible. The coasters of the present invention may incorporate an absorbent pad or depending wick elements which are associated with drain holes in a primary tray element which is supported in spaced vertical relationship with respect to a base element in such a manner that the absorbent material or wicks are subject to a cross ventilation between the tray and the base element.

2. History of the Related Art

Coasters for use with glass and bar ware and other beverage containers have found widespread use over the years. The coasters not only provide a beneficial effect by protecting the surface of furniture from accidental spills and moisture which condenses along the surface of such containers but also, in many cases, are designed to facilitate the removal of moisture from the surface of the glassware or container so that the moisture is not retained on or transferred to the container during use.

The most simplistic type of coasters or container trays are exemplified by having a base portion that is surrounded by an upstanding flange. Generally, such coasters are circular in shape and are of a sufficient size so that the base of a glass or other container such as a beverage can or bottle may be cooperatively seated on the base just inwardly of the annular flange. The coaster serves to protect the furniture surface and any moisture which develops or any spills are collected on the base and retained by the flange so that the moisture is not allowed to pass to the surface of the table or other furniture. Unfortunately, the use of very simple coasters does not provide adequate protection especially in areas or times when the amount of moisture associated with surface condensation along a container or glass results in a significant amount of moisture being collected within the coaster. If the coaster simply provides a collection surface which is exposed to the base of the container or glass, each time the container or glass is placed within the coaster, the base of the glass or container will become wet so that as the container or glass is raised with respect to the coaster, moisture will be removed from the coaster and allowed to drip either along the top of the furniture or on the individual utilizing the container or glass.

In order to avoid the problem associated with moisture buildup in the base of coasters, many coasters have been designed to provide for drainage of any collected moisture away from the supporting surface of the coaster. In an earlier U.S. Pat. No. 406,120 to Kiel, a coaster is shown which includes an upper support surface having a plurality of channels and openings formed therein with the channels directing any spilled or condensed moisture to openings provided in the support surface. The coaster includes an inner chamber in which the moisture which passes through the openings in the container support surface is collected. With this type of coaster, there is no significant buildup of moisture on the supporting portion of the coaster thereby preventing moisture from contacting a container as it is placed on the supporting surface. Unfortunately, the moisture which is collected within the chamber of the coaster must still be disposed of which requires additional handling of the coaster and which handling can result in accidental spillage of the collected liquid. Further, if the liquid which has been condensed and collected within the chamber is cooler than the exterior or ambient air, further condensation can develop on the exterior portion of th coaster thereby creating a situation which the coaster was originally designed to protect against and moisture may be allowed to contact the surface of the furniture which can result in damage to the furniture finish.

In an effort to avoid some of the drawbacks which are associated with coasters or container trays which are provided with drainage surfaces and collection receptacles such as discussed above, many coasters have been designed to incorporate or include an absorbent material which material serves to trap and retain any moisture which is collected within the coaster. In U.S. Pat. No. 508,140 to Koch, a coaster is disclosed which includes an absorbent pad which is mounted within a caster frame. The absorbent pad serves to collect spills and moisture which collects along the sides of the glass by condensation. Unfortunately, the frame of the coaster is open intermediate the pad and the surface of the furniture for the express purpose of allowing the absorbent pad to not only collect moisture from the container or glass but also to absorb the moisture from the table. Therefore, the absorbent pad simultaneously is allowed to collect and deposit moisture with respect to the surface of the table so that no protection is provided relative to the table to prevent moisture from contacting the surface. Thus, the surface finish of the table or other furniture on which the coaster is placed may become damaged. Further, after the absorbent pad becomes moisture laden, the pad associated with the coaster will not adequately retain condensate or other spilled moisture associated with the use of the container or glass which is supported by the coaster.

In U.S. Pat. Nos. 2,118,236 to Richardson, Jr. and 2,709,905 to Dunlap, two additional coaster structures are disclosed which incorporate absorbent pads which are contained within a coaster frame. Each of these coasters has an advantage over the aforementioned coaster of Koch in that the coasters contain or include a bottom wall which protects the surface of the furniture from being directly exposed to, or being directly in contact with, the absorption pad associated with the coaster. However, each of the coasters to Richardson, Jr. and Dunlap will have the same disadvantage as Koch in that the absorption pad is directly exposed to contact with the glass or other container which is supported in the coasters. Therefore, as the pads become moisture laden, they will not be effective in collecting and retaining additional moisture which condenses on the glassware or other container and a point will be reached when moisture will be lifted from the pad each time a container is lifted from the coasters thereby allowing water or moisture to drip exteriorly of the coaster. Additionally, in Dunlap, the pad is designed to be installed through a slot adjacent the bottom of the coaster. If the pad becomes too wet, moisture can pass through the open slot adjacent the base of the coaster and again be deposited on the surface of the furniture causing possible damage to the furniture finish.

Another type of coaster element is disclosed in U.S. Pat. No. 821,208 to Voss. In this coaster, the coaster frame is formed in two parts which are seated relative to one another so as to retain an absorbent cloth element across the upper surface of the coaster. Any moisture that is absorbed by the cloth may be transmitted along the length of the cloth through openings in an inner side wall of the coaster and thereafter be deposited in an annular trough formed in the coaster. With this type of coaster element, excess moisture is collected in an open annular chamberfrom which the condensate can be accidentally spilled or discharged. Further, if the condensate remains colder than the exterior environment, further condensation may take place on the exterior surface of the coaster.

In an effort to prevent accidental condensation or dripping of moisture from a glass or other container every time it is lifted from a coaster due to contact with a wet surface, other coaster elements have been designed to attempt to draw the liquid away from the container surface as the container is lifted from the coaster. In U.S. Pat. No. 2,595,961 to Layne, a coaster is disclosed which has an inner support surface formed of a plurality of upstanding finger or pillar elements which are closely associated with respect to one another so as to cause a capillary movement of water away from the container as the container is lifted relative to the coaster. Unfortunately, with this type of coaster element, the moisture is allowed to collect in the areas between each of the finger elements and therefore the moisture must be poured from the coaster at a point in time when sufficient moisture has been collected in the coaster. Accidental spills therefore become a problem with the use of this type of coaster.

Other types of coasters have provided absorbent material and spaced the absorbent material away from the supporting surface of the coaster so that the absorbent material does not come into direct contact with the container or glass being supported in the coaster. Examples of such structures are disclosed in U.S. Pat. Nos. 482,603 to Weigel, 2,496,157 to Gaudino, 2,652,703 to Keegan and 3,268,198 to Swett. Each of these structures has an upper supporting element which includes openings or passageways which allow moisture to pass beneath the support to an enclosed area in which an absorbent material is seated. Unfortunately, with these types of structures, moisture is again allowed to continue to collect and build up within the coaster and therefore moisture may be accidentally spilled as the coaster is moved from one point to another. In addition, in those instances where the coasters,are manufactured of materials having poor insulating capabilities, further condensation is possible along the exterior surface of the coaster which condensation may effect the finish of the furniture which the coaster was originally designed to protect.

In view of the foregoing, although there have been numerous designs proposed for coasters, such designs have not adequately met the need to not only protect the furniture finish on which the coaster is placed but also have not sufficiently provided for retaining the surface of the coaster in a dry state so as to prevent moisture from dripping from the base portion of a glass or other container supported by the coaster. One additional example of the prior art is disclosed in U.S. Pat. No. 4,089,498.

SUMMARY OF THE INVENTION

This invention is directed to coasters for supporting glasses and other containers on furniture and which include trays which are mounted in spaced vertical relationship from a base element in such a manner that open air spaces are created therebetween. Each base element includes a continuous plate which is mounted upon a soft and scratch resistant material and from which plate extends post elements which serve to support a tray above the base plate. Each base is further provided, in a preferred embodiment, with an upstanding annular flange which also terminates in spaced relationship with respect to the lower surface of a tray. Each tray includes a surface portion which is surrounded by an upstanding annular flange nd also includes a plurality of openings therethrough. The trays may be slightly concavely formed so as to facilitate the channeling of any moisture to the openings therein.

In a preferred embodiment, the upper surface portion of each tray will also include a plurality of channels which extend both radially outwardly and in concentric annular relationship along the surface thereof. The channels communicate with the openings in the tray to thereby channel any moisture directly to the openings.

In a first embodiment of the invention, a plurality of wick elements are disposed adjacent the lower surface of the trays and proximate to each of the openings therethrough. The wicks extend downwardly into the air spaces which are created between the trays and the plates of the bases. In a second embodiment, the wick elements may be uniformly formed or extend from absorbent pads which are either directly secured to the lower surfaces of the trays or are supported by the post elements so to be in direct contact with the lower surface of the trays. Preferably, the absorbent pads include texturized surfaces which extend into the open spaces between the trays and the base plates.

It is a primary object of the present invention to provide coasters which may be utilized to support glasses and other beverage containers and which are specifically designed to channel moisture in the form of evaporation or spills away from the base of such containers so that the tray support of the coasters are maintained relatively dry.

It is another and also primary object of the present invention to provide coasters which include structures for channeling liquids away from the tray support portions of the coasters to a point where the moisture may be evaporated by the movement of air through the coasters so that there is no continual buildup of moisture within the coasters which could result in accidental spillage or require periodic draining.

It is also an object of the present invention to provide coasters which may be utilized to absorb condensation from glasses, bottles, cans and other beverage containers and which do so in a manner which prevents further condensation on the coaster and thereby prevents any moisture from accumulating on the surface of any furniture on which such coasters are placed.

It is a further object of the present invention to provide coasters which may have replaceable wick or absorbent pad elements which pad elements may be utilized over an extended period of time and be replaced as required after they have BE come dirty or contaminated by prolonged use.

BRIEF DESCRIPTION OF THE DRAWINGS

FIG. 7 is an enlarged partial cross sectional view taken along lines 7—7 of FIG. 2, and is an assembly view of one embodiment of the

DESCRIPTION OF THE PREFERRED EMBODIMENT

Figure 1:
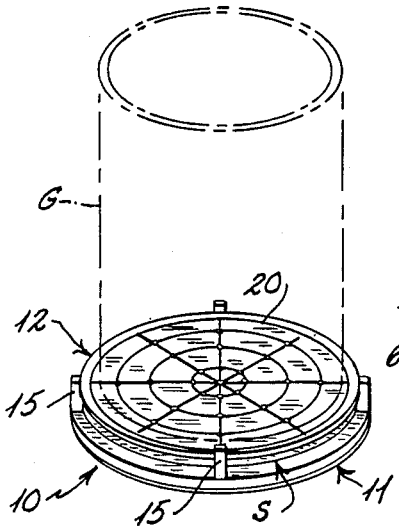
FIG. 1 is a perspective view of the coaster of the present invention showing a glass container in dotted line being supported on the tray surface.
Figure 2:
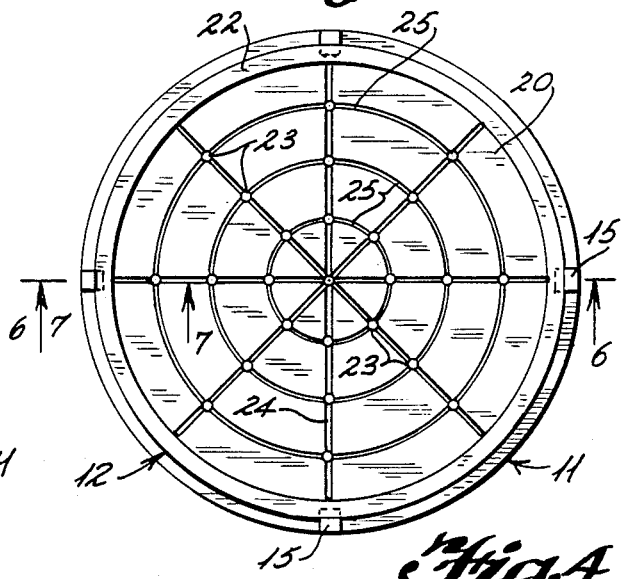
FIG. 2 is an enlarged top plan view of the coaster of FIG. 1.
Figure 3:
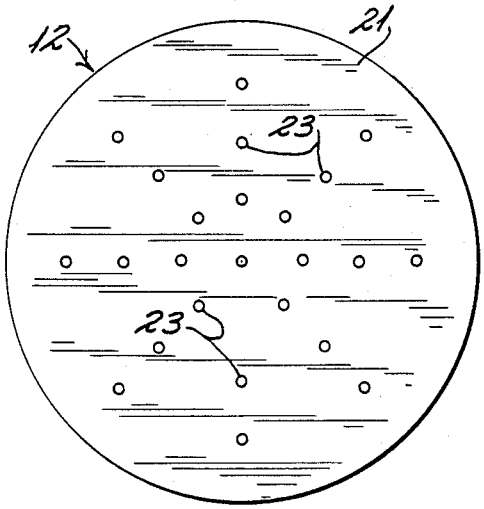
FIG. 3 is an enlarged bottom plan view of the upper tray element of the coaster of FIG. 1.

With continued reference to the drawings, the coaster 10 of the present invention is shown as being of a size to support a conventional drinking glass G. The size of the coaster, however, may vary depending upon the size of the container that is to be supported on the coaster. For instance, some coasters will be manufactured to be large enough to support conventional drinking mugs and therefore would require a base significantly greater in diameter than the coaster which would support a conventional drinking glass. In addition, coasters could be made of a size to support ice buckets and similar larger containers. Further, although the configuration of the coaster is shown in the drawings as being generally circular, the shape of the coaster may vary and may be rectangular or multi-sided without deviating from the inventive characteristics of the overall structure.

Figure 8:
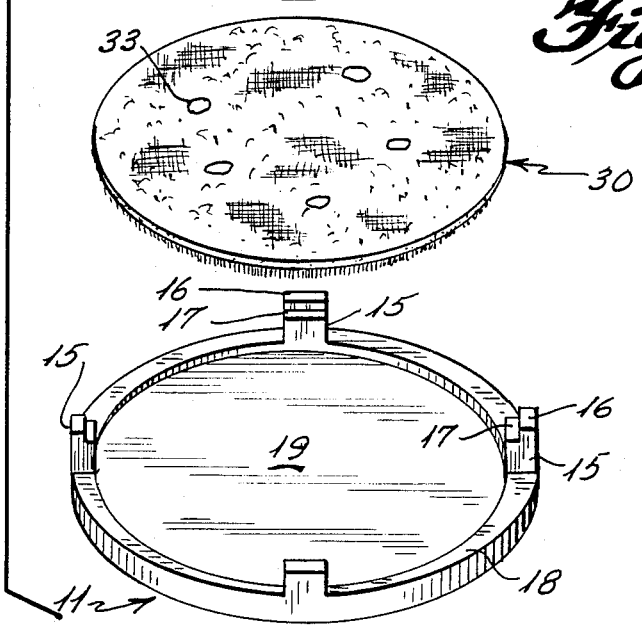

The coasters of the present invention each include a base portion 11 and a tray element 12. The base portion 11 includes a generally continuous plate 13 which is mounted upon a pad element 14 so that the coaster may be placed upon any furniture surface without causing any damage to the surface finish. The pad element 14 is preferably formed of a felt or other soft material while the plate 13 of the base portion is preferably formed of a wood or plastic material which is substantially non-heat conducting although other materials may be utilized in some instances. The base portion also includes a plurality of upwardly extending posts 15 which are oriented in generally equally spaced relationship adjacent the outermost periphery of the base plate 13. Each post includes an uppermost portion or end 16 and an intermediate flange or seat 17 which is spaced above the plate 13 of the base portion. With particular reference to FIG. 8, the base plate 13 is also preferably formed having an integral outer raised annular wall 18. Each of the post elements 15 is preferably mounted along the upper surface or is integrally formed with the upper surface of the annular wall 18. The base plate 13 and annular wall 18 define a collection area generally designated at 19 in which various fluids may be received in some instances as will be discussed in greater detail hereinafter.

The coasters of the present invention are uniquely designed to incorporate the shelf element 12 and to space the shelf element remotely from the base portion 11. In this manner, an air space S is created between or intermediate the base portion including the base plate 13 and annular wall 18 and the tray element 12 so that air may flow evenly between such portions and elements. The tray includes an upper surface 20 and lower surface 21. The upper surface of the tray may be slightly concavely shaped or tapered toward the center C for purposes of facilitating drainage of liquids deposited along the upper surface of the tray. An annular wall 22 extends upwardly from the outer periphery of the tray element 12 and serves to prevent any liquid from dripping over the edge of the tray when the coaster is in use. The tray element 12 is preferably formed of a wood or a plastic material which is not a good heat conductor although other materials may be utilized in some instances.

A plurality of openings 23 are also provided through the tray element 12 and are shown in the drawings as being formed in a patterned relationship with respect to one another although the openings could be oriented in a non-patterned relationship. To further facilitate the movement of liquids along the upper surface of the tray element, a plurality of radially extending channels 24 and concentric annular channels 25 are provided in the upper surface of the tray element. Each of the channels 24 and 25 communicates with a plurality of the openings 23 so that liquid may be channeled directly to the openings as the liquid is deposited or is collected along the upper surface of the tray element. Due to the configuration of the sloped upper surface of the tray element, any moisture collecting on the upper surface will flow by gravity to one of the channels 24 or 25 and thereafter be conducted to one of the openings 23. To facilitate the collection of moisture passing through the openings 23, the present invention incorporates a unique absorbent pad element 30 which is designed to either be secured to or mounted directly below and in contact with the lower surface 21 of the tray element 12.

Figure 4:
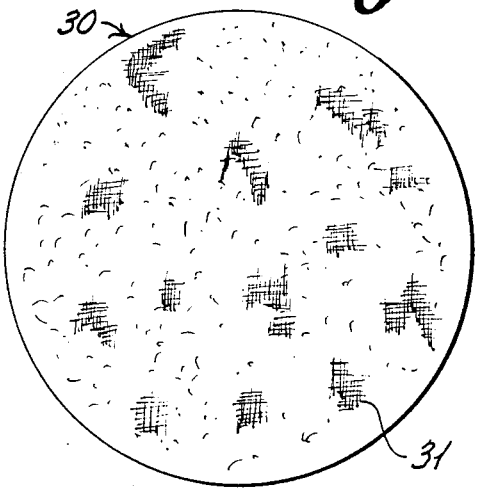
FIG. 4 is an enlarged bottom plan view of one embodiment of absorbent pad material having depending wick elements that may be utilized with the present invention.
Figure 5:
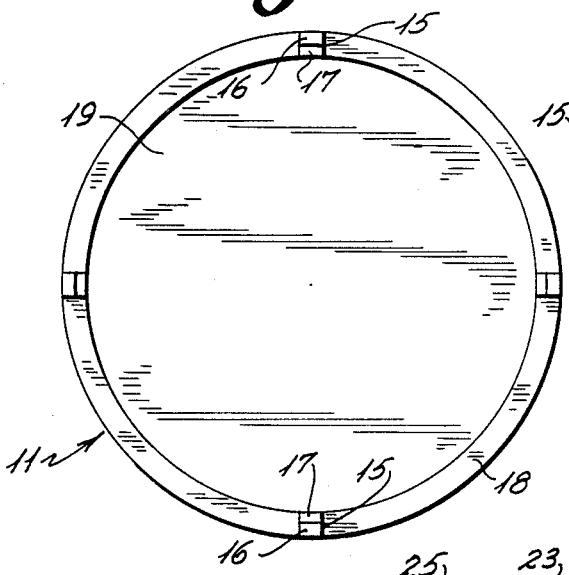
FIG. 5 is an enlarged top plan view of the base portion of the present invention.

With particular reference to FIGS. 4 and 5 of the drawings, one embodiment of absorbent member 30 is disclosed in greater detail. In this embodiment, the absorbent pad element 30 is disclosed of being of generally circular configuration and being approximately the same dimension as the tray element 12. The absorbent pad further includes a plurality of depending tufts of material or wick elements 31 which extend downwardly from the lower surface 32 of the pad when the pad is mounted in vertically spaced position relative to the base portion of the coaster. In some instances, as shown in FIG. 8, it may be possible to secure the pad to the lower surface of the tray element by providing spots of adhesive 33 along the upper portion 34 thereof by way of which the pad may be temporarily secured to the lower surface of the tray. In the embodiment of FIGS. 4 and 5, however, the pad is designed to be generally self-supporting and is seatable on the flange elements 17 associated with each of the posts 15 of the base portion of the coaster. Thereafter, the tray element 12 is designed to be seated in overlying contact with the pad element and also being supported by the flange elements 17 associated with each post 15. In either embodiment, the absorbent pad is designed to be disposable after a period of use and upon the determination that the pad may have become soiled either from spills of specific fluids or because of dust or dirt in the surrounding environment.

Figure 6:
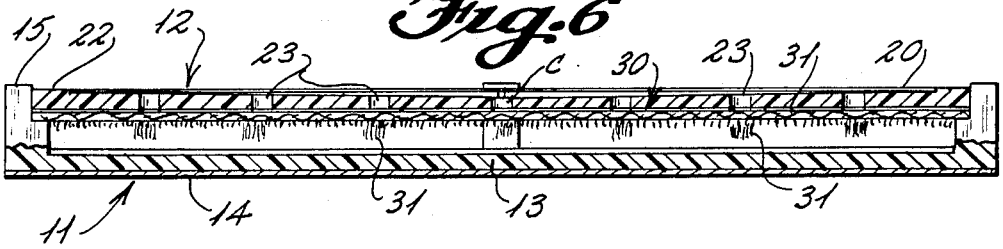
FIG. 6 is an enlarged cross sectional view taken along lines 6—6 of FIG. 2 showing the wick elements depending into the air space between the base portion and tray portion of the present invention.
Figure 7:
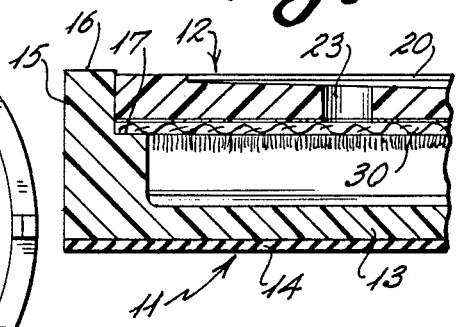
Figure 7:
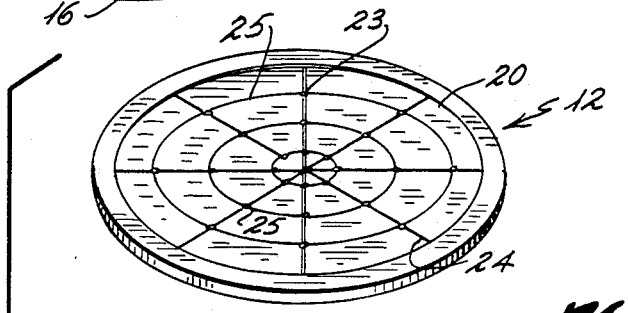

It should be noted that the absorbent pad which is utilized with the present invention and which may include depending wick elements 31 is designed so the wick elements 31 are spaced vertically above the base portion. The material from which the absorbent pad is made may incorporate a pattern of depending fibers or tufts such as exemplified in the embodiment shown in FIG. 6 as opposed to uniformly depending fibers as shown in FIG. 7. In either case, however, it is a purpose of the absorbent pad to not only collect liquids passing through the openings 23 but to channel the liquids downwardly through the fibers so that the water is exposed to the air moving in the air space S between the tray element and the base portion of the coaster. In this manner, any moisture absorbed into the pad 30 will be subject to evaporation thereby enabling each absorbent pad to become self-drying. Further, this structure significantly reduces the amount of moisture that may, if ever, be collected in the lower collection portion 19 of the base portion of the coaster. Also, any moisture that does drop through or that does drip into the collection portion 19 of the base portion will also be subject to evaporation due to the air movement through the air space between the base portion and the tray element of the present invention.

A further significant advantage in the present invention is that any liquids being collected by the tray element and absorbed by the absorbent pad will have the opportunity to be elevated to room temperature as the liquid is exposed to ambient air in the air space S. Therefore, in the event that the coaster is made from metallic material or has a metallic base portion, any liquid which does drip from the absorbent pad to the base portion and into the collection portion 19 will be at room temperature or ambient temperature and thereby no condensation should form along the exterior walls of the base portion of the coaster.

Although not specifically shown in the drawings, the tray element 12 and the absorbent pad 30 may be provided as a single disposable unit wherein the tray element is formed of a plastic material having an absorbent pad directly adhesively secured thereto. After the absorbent material becomes dirty over prolonged use or contaminated by the spill of liquid which cannot be removed from the absorbent material, it would only be necessary to discard the entire unit and then replace the unit with a second tray and pad combination.

With respect to FIG. 8 of the drawings, in use and assembly of the coaster of the present invention, the base portion is first placed upon a support surface such as a table top with the post elements extending vertically upwardly. A pad element 30 is thereafter inserted so that the depending fibers or any tufts associated with the material extend downwardly towards the collection or receptacle portion 19 of the base portion. The absorbent pad is then seated on the flange element 17 of each of the posts and thereafter the tray element 12 seated over the absorbent pad 30. In instances where adhesives are applied such as shown at 33 to secure the absorbent pad to the lower surface of the tray element, the absorbent pad may be placed on the lower surface of the tray element and then the combination tray element and pad inserted into seated engagement with the flanges 17 of the support posts 15.

When the coaster is being utilized, each time a glass or other container is placed on the upper surface of the tray element, any condensation or liquid which drips from the side or bottom of the container will be directed by the sloping upper surface and channels 24 and 25 made in the upper surface to the openings 23. Liquid passing through the openings 23 will be absorbed and drawn into the absorbent pad 30 and thereafter conducted by gravity and capillary action to the downwardly extended tufted portions or wick elements which are integrally formed with the pad into the air space S defined between the base portion and the tray element. The moisture in the pads will thereby be subjected to evaporation thereby maintaining the pad in a dryer state than is possible with prior known and prior art coasters.

I claim:

1. A coaster for supporting containers relative to a surface comprising a base portion and a container supporting tray element, at least one vertically extending post means for supporting said tray element in vertically spaced relationship with respect to said base portion so as to define an air space therebetween through which ambient air is free to pass, said tray element having upper and lower surfaces, at least one opening through said tray element and between said upper and lower surfaces, and at least one absorbent wick means mounted proximate to said opening adjacent said lower surface of said tray element, said absorbent wick means being spaced from said upper surface of said tray element, and said base portion including a receptacle portion, said receptacle portion being oriented in vertically spaced relationship below said at least one absorbent wick means, whereby any moisture passing through said opening from said upper surface of said tray element to said lower surface thereof will be absorbed by said wick means and be exposed to evaporation in the air space created between said base portion and said tray element.

2. The coaster of claim 1 including a plurality of openings through said tray element between said upper and lower surfaces thereof, and said at least one absorbent wick means including an absorbent pad which is mounted adjacent to and generally coextensive with said lower surface of said tray element.

3. The coaster of claim 2 including at least one channel formed in said upper surface of said tray element, said at least one channel communicating with at least two of said openings in said tray element.

4. The coaster of claim 2 in which said openings are formed through said tray element in a patterned arrangement, a first set of radially extending grooves formed in said upper surface of said tray element and communicating with a plurality of said openings and a second concentrically oriented set of channels formed in said upper surface of said tray element and each of said concentric channels communicating with a plurality of openings through said tray element.

5. The coaster of claim 2 including a plurality of said post means, each of said post means extending upwardly from said base portion and having upper ends, each of said post means having an outwardly extending flange spaced intermediate said upper ends of said post means and said base portion of said coaster, said tray element being selectively seated on said flange members of said post means.

6. The coaster of claim 5 in which said absorbent pad is selectively seated on said flange elements of said post means so as to be intermediate said flanges and said lower surface of said tray element.

7. The coaster of claim 6 in which said absorbent pad is adhesively secured to said lower surface of said tray element.

8. The coaster of claim 6 in which said absorbent pad includes a plurality of vertically depending tufts of material which extend into said air space between said tray element and said base portion.

9. A coaster for supporting containers relative to a surface comprising a base portion and a container supporting tray element, a plurality of vertically extending post means extending vertically between said base portion and tray element for supporting said tray element in vertically spaced relationship with respect to said base portion so as to define an air space therebetween through which ambient air is free to pass, said tray element having upper and lower surfaces, a plurality of openings through said tray element and between said upper and lower surfaces, and absorbent pad means mounted proximate to said opening adjacent said lower surface of said tray element so as to extend into said air space, said absorbent pad means being spaced from said upper surface of said tray element, said base portion including a receptacle portion, said receptacle portion being oriented in vertically spaced relationship below said absorbent pad means, whereby any moisture passing through said openings from said upper surface of said tray element to said lower surface thereof will be absorbed by said pad means and be exposed to evaporation in the air space created between said base portion and said tray element.

10. The coaster of claim 9 including at least one channel formed in said upper surface of said tray element, said at least one channel communicating with at least two of said openings in said tray element.

11. The coaster of claim 9 including a first set of radially extending grooves formed in said upper surface of said tray element and communicating with at least two of said openings and a second concentrically oriented set of channels formed in said upper surface of said tray element and each of said concentric channels communicating with at least two of said openings through said tray element.

12. The coaster of claim 9 in which each of said post means includes an upper end and an outwardly extending flange spaced intermediate said upper end and said base portion of said coaster, said tray element being selectively seated on said flanges of said post means.

* * * * *